US010470585B2

(12) United States Patent
Robbins et al.

(10) Patent No.: US 10,470,585 B2
(45) Date of Patent: Nov. 12, 2019

(54) APPARATUS AND METHOD FOR AN ADJUSTABLE MODE CHILD ROCKER AND SWING

(71) Applicant: GRACO CHILDREN'S PRODUCTS INC., Atlanta, GA (US)

(72) Inventors: Chad Brandon Robbins, Atlanta, GA (US); Brian S. Kelly, Alpharetta, GA (US); Ryan William Nottage, Marietta, GA (US); Lauren Pusey, Woodstock, GA (US); Andrew Liu, Atlanta, GA (US); Nicholas E. Papageorge, Atlanta, GA (US)

(73) Assignee: GRACO CHILDREN'S PRODUCTS INC., Atlanta, GA (US)

( * ) Notice: Subject to any disclaimer, the term of this patent is extended or adjusted under 35 U.S.C. 154(b) by 5 days.

(21) Appl. No.: 15/949,525

(22) Filed: Apr. 10, 2018

(65) Prior Publication Data

US 2018/0296006 A1 Oct. 18, 2018

Related U.S. Application Data

(60) Provisional application No. 62/484,636, filed on Apr. 12, 2017, provisional application No. 62/599,965, filed on Dec. 18, 2017.

(51) Int. Cl.
*A47D 13/10* (2006.01)

(52) U.S. Cl.
CPC ..... *A47D 13/105* (2013.01)

(58) Field of Classification Search
CPC ..... A47D 13/105; A47D 9/02; A47D 13/10; A47D 13/102
See application file for complete search history.

(56) References Cited

U.S. PATENT DOCUMENTS

| | | | | |
|---|---|---|---|---|
| 4,258,446 | A * | 3/1981 | McAllister | A47D 9/02 5/105 |
| 4,911,499 | A | 3/1990 | Meeker | |
| 7,717,798 | B2 * | 5/2010 | Bellows | A47D 13/10 472/36 |
| 7,722,118 | B2 | 5/2010 | Bapst et al. | |
| 7,789,762 | B2 * | 9/2010 | Greger | A47D 13/105 472/118 |

(Continued)

*Primary Examiner* — Philip F Gabler
(74) *Attorney, Agent, or Firm* — Eversheds Sutherland (US) LLP

(57) ABSTRACT

An adjustable mode child rocker can be adjusted to provide a number of different swinging/rocking motions to a child positioned within the rocker. The child rocker can include a seat assembly that can include a seat upon which a child can sit. The child rocker can also include a trolley assembly that is directly or indirectly attached to the seat assembly and can include multiple wheels near the bottom of the trolley assembly. The child rocker can also include at least one stationary track and at least one adjustable track for the wheels to move along to provide the different rocking/swinging motions to the seat assembly. The adjustable track(s) is adjustable from at least a first position to a second position to change the distance between the troughs of the respective stationary and adjustable tracks along a longitudinal axis of the child rocker and thereby changing the rocking/swinging motion.

20 Claims, 11 Drawing Sheets

(56) References Cited

U.S. PATENT DOCUMENTS

| | | | | |
|---|---|---|---|---|
| 8,047,609 | B2 * | 11/2011 | Chen | A47D 13/10 297/260.1 |
| 8,197,005 | B2 * | 6/2012 | Hopke | A47D 9/02 297/344.17 |
| 9,033,415 | B2 * | 5/2015 | Hopke | A47D 9/02 297/260.2 |
| 9,795,891 | B1 * | 10/2017 | Logan | A47D 13/10 |
| 2002/0113469 | A1 * | 8/2002 | Stern | A47D 13/10 297/256.16 |
| 2006/0012230 | A1 * | 1/2006 | Kennedy | A47C 3/02 297/261.3 |
| 2012/0216347 | A1 * | 8/2012 | Tundo | A47C 3/02 5/109 |
| 2015/0223615 | A1 | 8/2015 | Hopke et al. | |
| 2016/0066708 | A1 * | 3/2016 | Sclare | A47D 13/105 297/260.2 |
| 2016/0227939 | A1 * | 8/2016 | Tadipatri | A47D 9/02 |
| 2018/0325280 | A1 * | 11/2018 | Paperno | A47D 9/02 |

* cited by examiner

APPARATUS AND METHOD FOR AN ADJUSTABLE MODE CHILD ROCKER AND SWING

RELATED APPLICATIONS

This application claims priority under 35 U.S.C. § 119 to U.S. Provisional Patent Application No. 62/484,636, filed Apr. 12, 2017, and titled "Apparatus and Method for an Adjustable Mode Infant Rocker and Swing," and to U.S. Provisional Patent Application No. 62/599,965, filed Dec. 18, 2017, and titled "Apparatus and Method for an Adjustable Mode Infant Rocker and Swing," the entire contents of each of which are hereby incorporated herein by reference for all purposes.

TECHNICAL FIELD

Embodiments disclosed herein are generally related to automated child swings and more particularly to apparatuses and methods for an automated child swing that is adjustable from a swing mode to a rocker mode.

BACKGROUND

Automated child swings are very useful in providing a diversion to infants. In most conventional child swings, the infant is laid into a seat attached to the child swing and the swing is activated. A motor attached to one or more arms of the swing may then begin moving the seat back-and-forth in a swinging motion. While conventional automated child swings and their one-dimensional operation are useful in comforting an infant in certain situations, in many cases, other rocking and/or swing modes may be better suited to comforting the infant. For example, where the infant is almost asleep, the swinging motion may be too much and may cause the infant to become fully awake. In other situations, the infant may need more substantial rocking or another type of motion to sooth the infant.

BRIEF DESCRIPTION OF THE SEVERAL VIEWS OF THE DRAWINGS

For a more complete understanding of the present disclosure and certain features thereof, reference is now made to the following description, in conjunction with the accompanying figures briefly described as follows.

DETAILED DESCRIPTION OF THE EXAMPLE EMBODIMENTS

Example embodiments of the disclosure now will be described more fully hereinafter with reference to the accompanying drawings, in which exemplary embodiments are shown. This invention may, however, be embodied in many different forms and should not be construed as limited to the example embodiments set forth herein; rather, these embodiments are provided so that this disclosure will be thorough and complete, and will fully convey the scope of the invention to those skilled in the art. Like numbers refer to like, but not necessarily the same or identical, elements throughout.

Certain dimensions and features of the example child swing/rocker (hereinafter referred to as a "child rocker" are described herein using the term "approximately." As used herein, the term "approximately" indicates that each of the described dimensions is not a strict boundary or parameter and does not exclude functionally similar variations therefrom. Unless context or the description indicates otherwise, the use of the term "approximately" in connection with a numerical parameter indicates that the numerical parameter includes variations that, using mathematical and industrial principles accepted in the art (e.g., rounding, measurement or other systematic errors, manufacturing tolerances, etc.), would not vary the least significant digit.

In addition, certain relationships between dimensions of the child rocker and between features of the child rocker are described herein using the term "substantially." As used herein, the terms "substantially" and "substantially equal" indicates that the equal relationship is not a strict relationship and does not exclude functionally similar variations therefrom. Unless context or the description indicates otherwise, the use of the term "substantially" or "substantially equal" in connection with two or more described dimensions or positions indicates that the equal relationship between the dimensions or positions includes variations that, using mathematical and industrial principles accepted in the art (e.g., rounding, measurement or other systematic errors, manufacturing tolerances, etc.), would not vary the least significant digit of the dimensions. As used herein, the term "substantially constant" indicates that the constant relationship is not a strict relationship and does not exclude functionally similar variations therefrom. As used herein, the term "substantially parallel" indicates that the parallel relationship is not a strict relationship and does not exclude functionally similar variations therefrom.

Figure 1A:
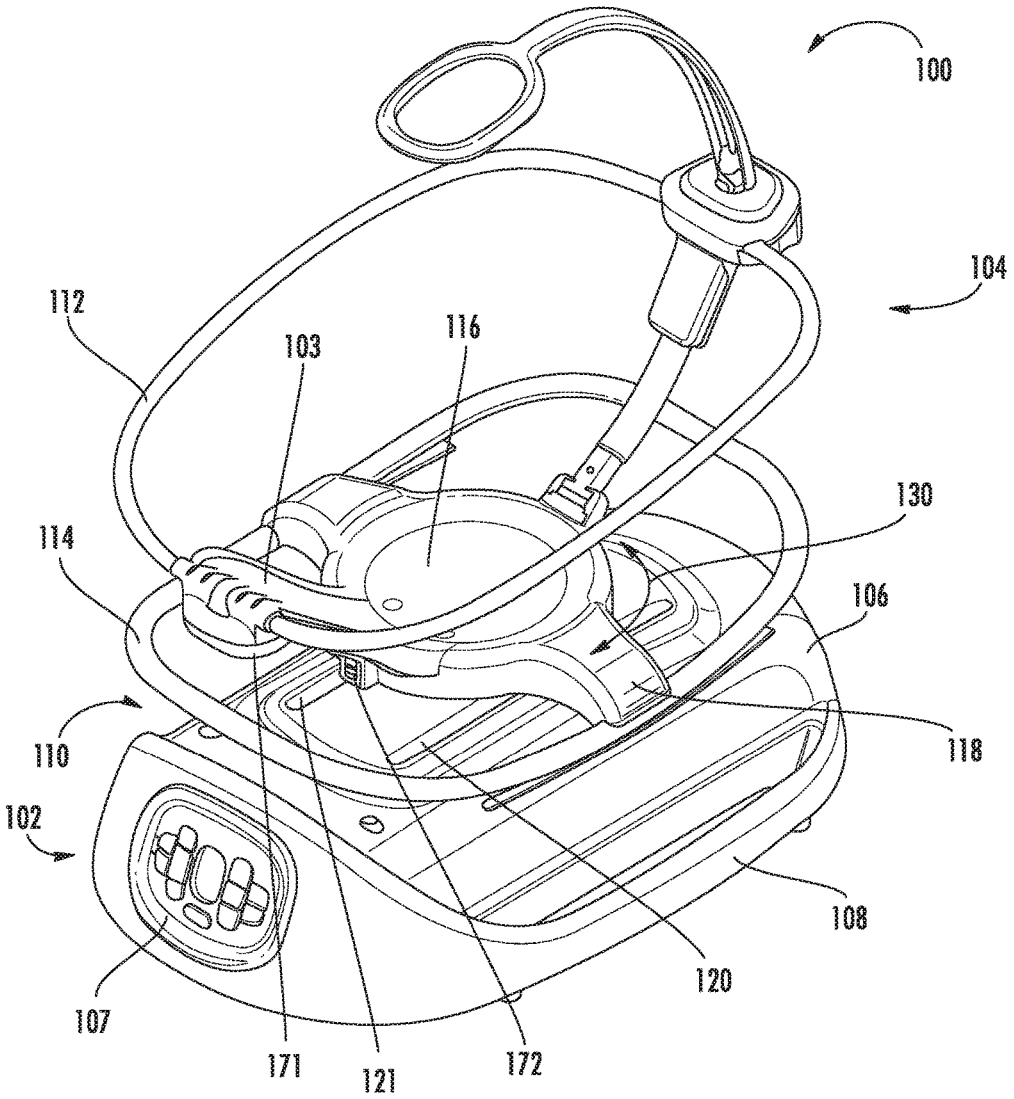
FIG. 1A is a perspective view of an adjustable automated child swing/rocker, in accordance with one example embodiment of the disclosure.
Figure 1B:
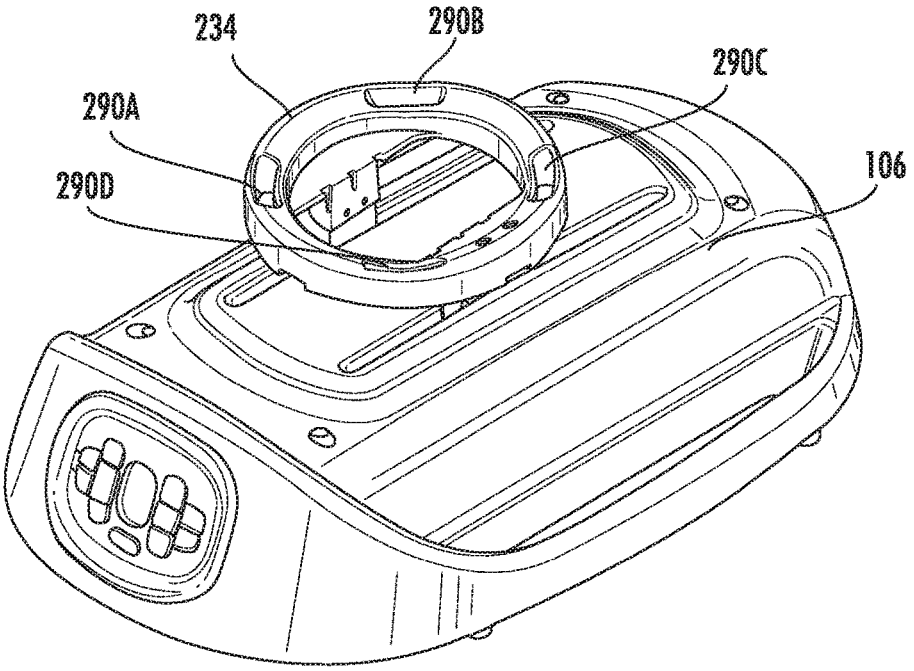
FIG. 1B is a perspective view of the base assembly of the adjustable automated child swing/rocker of FIG. 1A with the seat assembly removed, in accordance with one example embodiment of the disclosure.
Figure 1C:
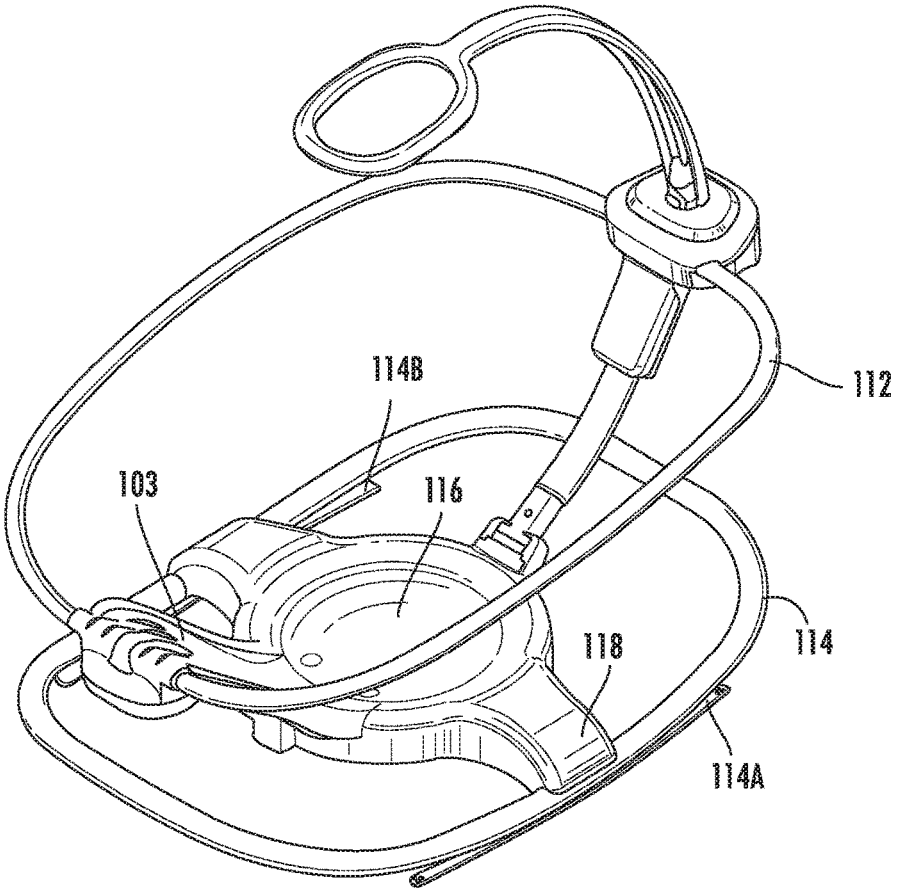
FIG. 1C is a perspective view of the seat assembly of the adjustable automated child swing/rocker of FIGS. 1A-1B in an independent rocker configuration, in accordance with one example embodiment of the disclosure.

FIG. 1A-1C are various views of an adjustable automated child swing/rocker 100, in accordance with one example embodiment of the disclosure. The adjustable automated child swing/rocker 100 will be described with regard to certain features. However, this description is not meant to be limiting to just those features as those of ordinary skill in the art will recognize that additional features and alternative features may be added or substituted for that described herein. Referring now to FIGS. 1A-1C, the example automated child rocker 100 can include a base assembly 102 removably coupled to a seat assembly 104.

In certain example embodiments, the seat assembly 104 can function as a manual rocker (e.g., like a rocking chair) when separated from the base assembly 102, as shown in FIG. 1C. Referring to FIG. 1C, the seat assembly 104 can be manually rocked by a person by rocking the seat assembly along the rocker frame 114 which can extend along the bottom end of the seat assembly. As discussed in greater detail below, the rocker frame 114 can be positioned along a bottom side of the seat frame 104. The rocker frame 114 can be constructed of one or more pieces of solid or tubular, metallic or plastic bar, railing, or tubing. The rocker frame 114 can have a curved profile from a front end 191 to an opposing back end 192 that is generally concave in shape towards the space above the rocker frame (or convex with respect to a floor surface upon which the rocker frame may rest or be placed upon) and can be at least substantially curved from a front end 191 of the rocker frame 114 to a back end 192 of the rocker frame 114 to allow the seat assembly 104 to rock along the bottom surface of the rocker frame 114 when disconnected from the base assembly 102. Alternatively, a first curved rocker member **114*a* can be coupled to the bottom surface of the rocker frame 114 and positioned along one lateral side of the seat assembly 104 and a second curved rocker member 114*b* can be coupled to the bottom surface of the rocker frame 114 and positioned along an opposing second lateral side of the seat assembly. Each of the first curved rocker member 114*a* and second curved rocker member 114*b* can have a generally concave shape towards the space above the rocker frame 114 (or convex with respect to a floor surface upon which the first curved rocker member 114*a* and second curved rocker member 114*b* may rest or be placed upon). In certain example embodiments, each of the first curved rocker member 114*a* and second curved rocker member 114*b*** can be made of solid or tubular material such as plastic, metal, composites, or any combination thereof.

Figure 2A:
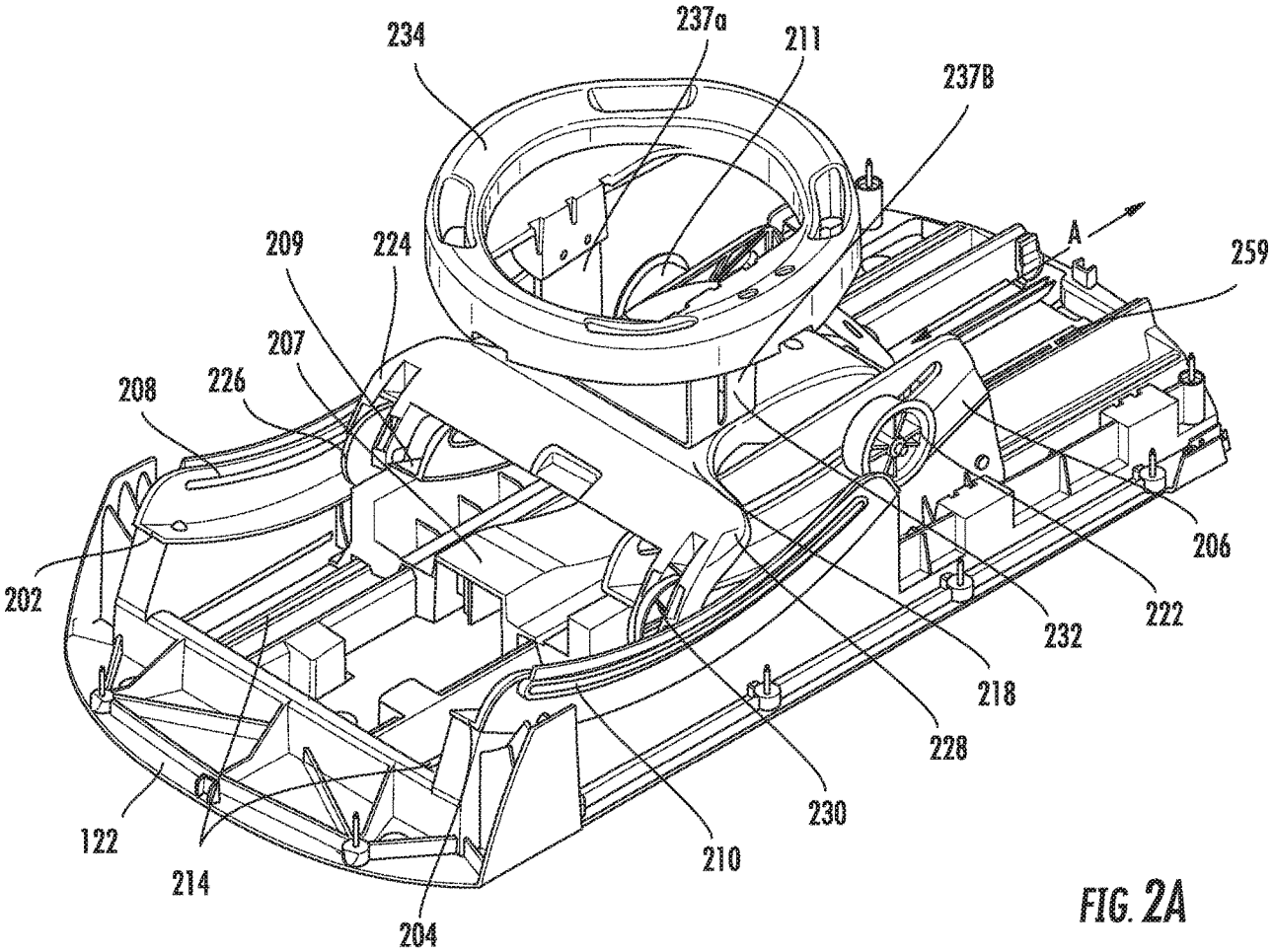
FIG. 2A is a perspective view of the internal components of the base assembly of FIGS. 1A-1C, in accordance with one example embodiment of the disclosure.
Figure 2B:
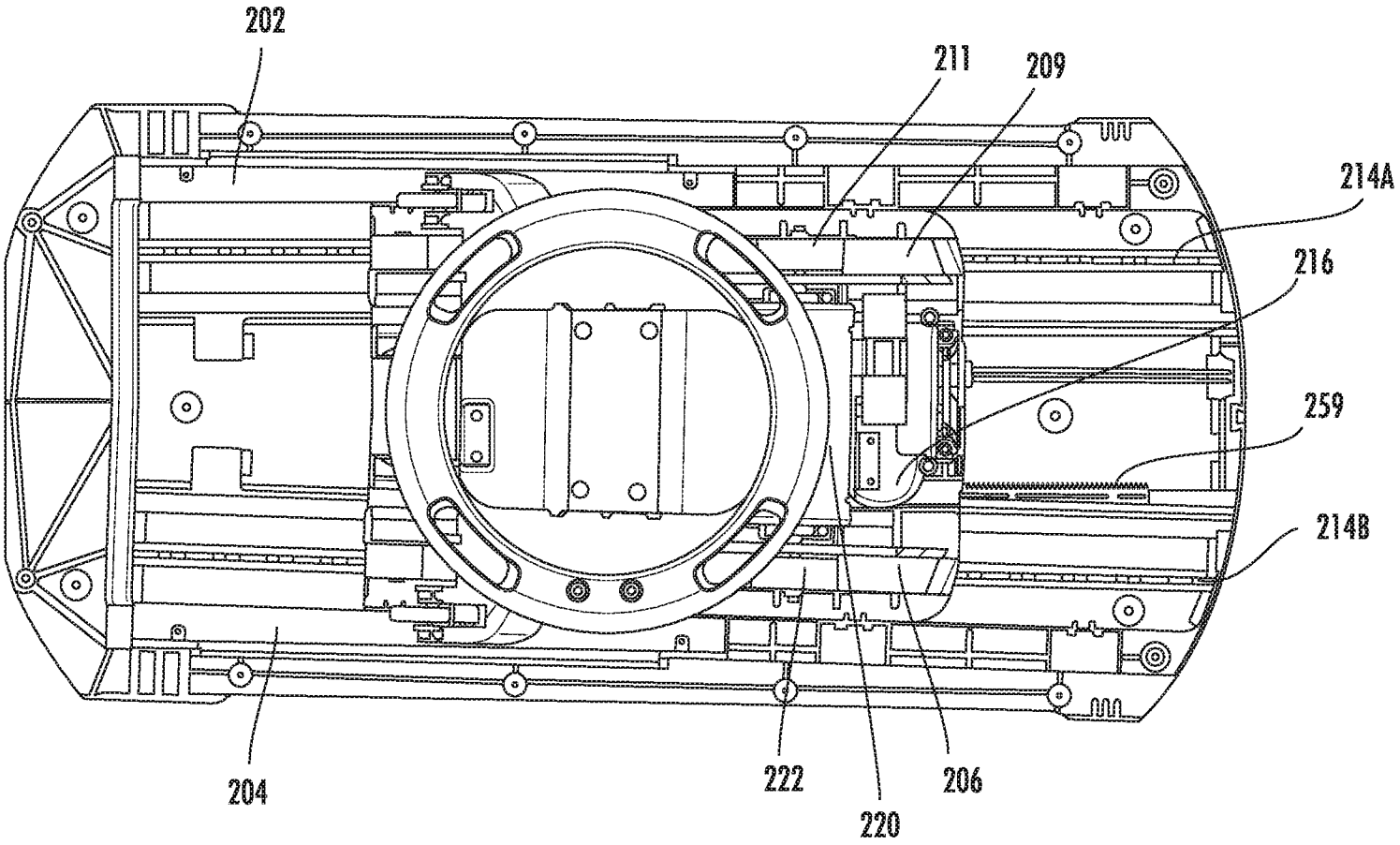
FIG. 2B is a top plan view of the internal components of the base assembly of FIGS. 1A-2A, in accordance with one example embodiment of the disclosure.
Figure 2C:
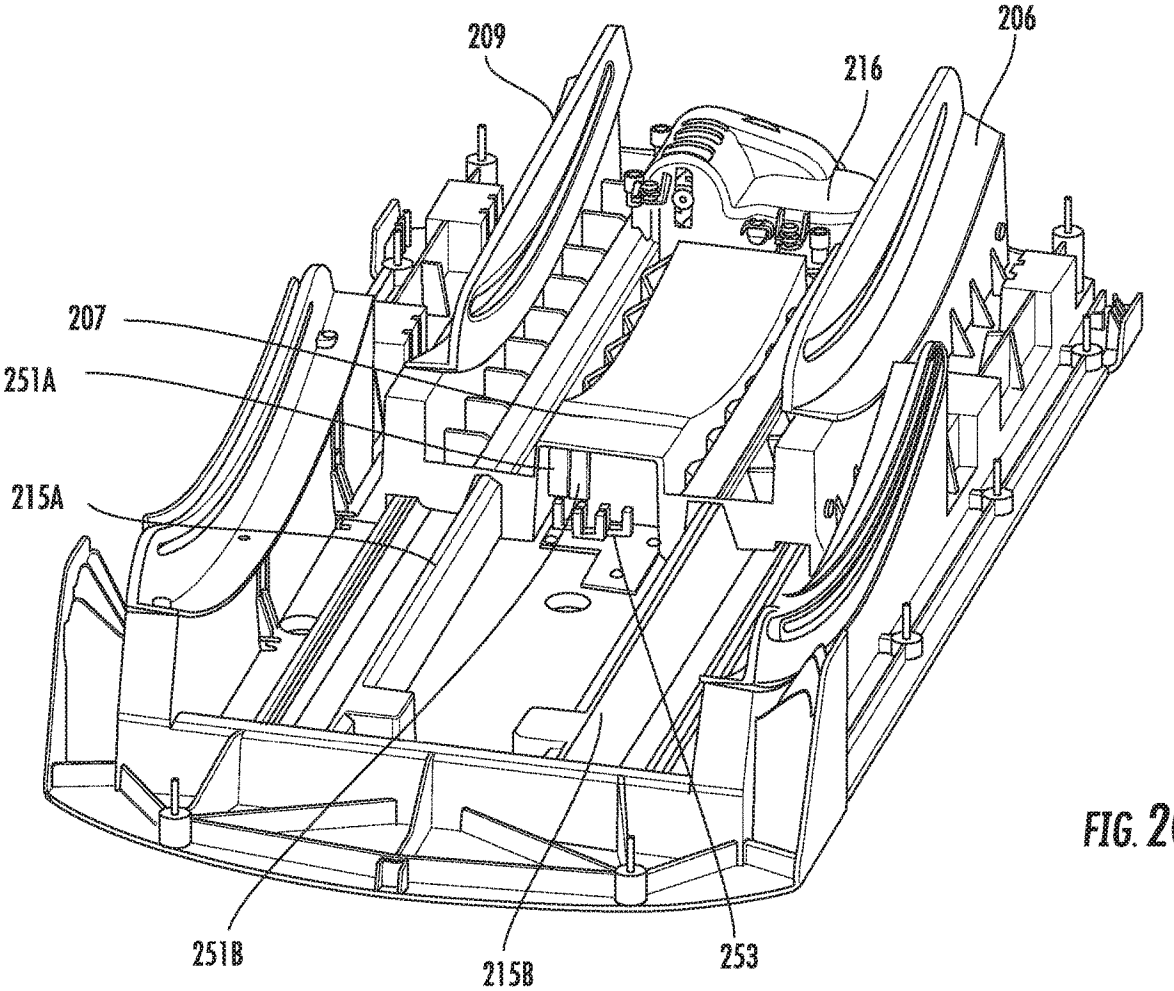
FIG. 2C is a partial perspective view of the internal components of the base assembly of FIGS. 1A-2B with the trolley assembly removed, in accordance with one example embodiment of the disclosure.
Figure 2D:
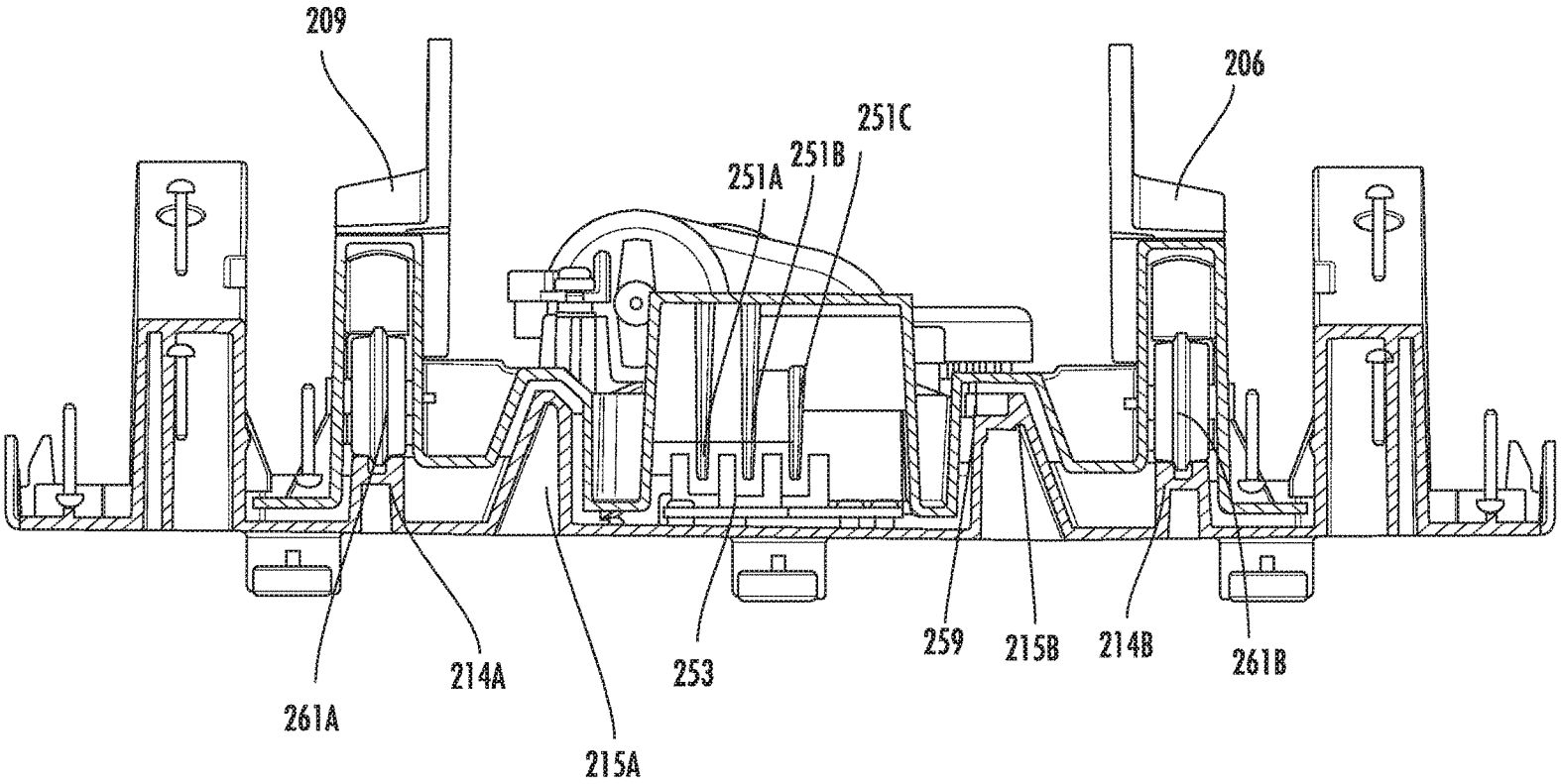
FIG. 2D is a partial cross-sectional view of the internal components of the base assembly of FIGS. 1A-2C with the trolley assembly removed, in accordance with one example embodiment of the disclosure.

The base assembly 102 can include a base bottom 122 (FIG. 2A) and a housing 106 that covers all or a portion of the base bottom 122. In one example, a cavity is provided between the base bottom 122 and the housing cover 106 that can support the components of the rocker and swing drive systems. In one example, the base bottom 122 and the housing cover 106 together form the base housing that defines the cavity. The housing cover 106 can be constructed of metal or plastic and can include one or more elongated track slots 120, 121 along a portion of the top side of the housing cover 106. In one example embodiment, two track slots 120, 121 are provided along the top side of the housing cover 106. However, fewer or greater than two track slots 120, 121 can be provided on other embodiments.

The elongated track slots 120, 121 can provide an opening through the top side of the housing cover 106 into the housing cavity and can allow for the connection of the seat assembly 104 to the trolley 218 (FIG. 2A) and thereby to the drive system and allow for translation or movement of the seat assembly 104 with respect to the base assembly 102 as caused by the drive system. In certain example embodiments, each of the elongated track slots can extend in a direction parallel or substantially parallel to the longitudinal axis A (FIG. 2A) of the base assembly 102.

The housing cover 106 can also include a control panel 107 communicably coupled to a processor (not shown) and/or other electronic components for controlling the operation of the child rocker 100. The processor and/or other electronic components for controlling the operation of the child rocker 100 can be coupled to the base bottom 122 or otherwise positioned within the cavity defined by the base bottom 122 and the base housing 106. For example, the base bottom 122 can include a flat or substantially flat bottom surface and a flat or substantially flat opposing top surface with one or more components coupled to or integrally formed on the top surface of the base bottom 122 and extending upward therefrom. In one example, the control panel 107 can include a touchpad and/or one or more switches, knobs, or levers, for turning the child rocker on and off, changing the type of swing or rocking motion, and/or changing the swing or rocking speed of the child rocker 100.

The base assembly 102 can also include a first outer rail 108 positioned along one lateral side of the housing cover 106 and a second outer rail 110 positioned along an opposing lateral side of the housing cover 106. Each outer rail 108, 110 can have a first end coupled to the housing cover 106 adjacent one end of the housing cover 106 and a second distal end coupled adjacent to the opposing end of the housing cover 106. A lateral gap or opening can be provided between each of the outer rails 108, 110 and the corresponding lateral side of a portion of the housing cover 106. The bottom side of each of the outer rails 108, 110 can be configured to contact the ground or other flooring surface and to provide stability and support for the child rocker 100. In one example, each of the outer rails 108, 110 is integrally formed with housing cover 106 and/or the base bottom 122.

The seat assembly 104 can include a seat frame 112, a rocker frame 114 operably coupled to the seat frame 112, a seat mounting cap 116 operably coupled to the seat frame 112 and the rocker frame 114, and a seat pan 103 extending from the seat mounting cap 116 to the seat frame 112. In one example, the seat frame 112 can include one or more pieces of tubular or solid bent bars, railing, or tubing. The bars, railing, or tubing can be made of metal, alloy, or plastic. The seat frame 112, seat pan 103, and/or the seat mounting cap 116 can also include padding and one or more soft goods (e.g., fabric, plastic, leather, or other materials) (not shown) that are configured to cover all or a portion of the seat frame 112, seat pan 103, and/or the seat mounting cap 116. The soft goods in conjunction with the seat frame 112, seat pan 103, and/or the seat mounting cap 116 can be configured to create a seat or bedding surface to support an infant or toddler on the seat assembly 104.

The rocker frame 114 can be positioned along a bottom side of the seat frame 112. The rocker frame 114 can be constructed of one or more pieces of solid or tubular, metallic or plastic bar, railing, or tubing. In one example, the rocker frame 114 can have a curved bottom surface and can be at least substantially curved from a front end of the rocker frame 114 to a back end of the rocker frame 114 to allow the seat assembly 104 to rock along the bottom surface of the rocker frame 114 when disconnected from the base assembly 102. The rocker frame 114 can be coupled to the seat assembly 104 by one or more support arms 118. Each support arm 118 can have a first end coupled to the seat mounting cap 116 and a distal second end coupled to a portion of the rocker frame 114. In one example, at least two support arms 118 are provided; however greater or fewer numbers of support arms 118 can be provided.

The seat mounting cap 116 can be removably coupled to a seat mounting dock 234. The seat mounting cap 116 can include a bottom surface and one or more tab members extending generally downward from the bottom surface of the seat mounting cap 116. In one example embodiment, four tab members extend down from the bottom surface of the seat mounting cap. However, the number of tab members can be greater or lesser than four. Each tab member can have a generally straight or curved cross-sectional profile along the horizontal plane to match the cross-sectional profile along the horizontal plane of corresponding slots 290A-D on the seat mounting dock 234. Each tab member can be radially spaced outward from a point along the bottom surface of the seat mounting cap 116 a distance that is equal or substantially equal to the radially spaced outward distance of each other tab member. Further, the center of each tab member can be circumferentially disposed about 90 degrees from an adjacent tab member. Such a spacing would allow for four position rotation 130 of the seat assembly 104 (at 0, 90, 180, and 270 degrees) about a vertical axis extending through the seat mounting dock 234.

Each tab member can be configured to be slidably inserted into a corresponding one of the slots 290A-D, apertures, or through holes in the seat mounting dock 234. In one example, the seat mounting dock 234 can have an annular ring shape or a solid circular shape. One or more slots 290A-D, apertures, or through holes, can extend completely or partially through the seat mounting dock 234 and can be positioned generally adjacent an outer circumferential edge of the seat mounting dock 234. In one example, four slots 290A-D, apertures, or through holes can be positioned through the seat mounting dock 234. Alternatively, greater or fewer than four slots 290A-D, apertures, or through holes can be provided. Further, the center of each slot 290A-D can be circumferentially spaced substantially 90 degrees from an adjacent slot 290A-D, aperture, or through hole. Alternatively, the spacing can be greater or less than 90 degrees and anywhere between 10-180 degrees. Generally the number of slots 290A-D, apertures, or through holes can be the same as the number of tabs along the bottom side of the seat mounting cap 116.

In one example, the shape and size of each tab member (or its cross-sectional profile along a horizontal plane) is the same to allow for the rotation of the seat assembly 104. In other example embodiments, one or more of the tab members may have a different size or shape. In one example, the slots 290A-D, apertures, or through holes in the seat mounting dock 234 can be keyed (e.g., one or more of the slots 290A-D, apertures, or through holes can have a different shape or size than at least one of the other slots 290A-D, apertures, or through holes), such that the seat mounting cap 116 can only fit onto the seat mounting dock 234 in one or more specific orientations. In one example, the seat mounting cap 116 is configured to be rotated 130 to fit onto the seat mounting dock 234 in four positions that are substantially 90 degrees relative to one another.

The rotation of the seat assembly 104 can be in either the clockwise or counter-clockwise directions. The user can lift the seat assembly 104 vertically upward so that the tab members of the seat mounting cap 116 are removed from the slots 290A-D, apertures, or through holes of the seat mounting dock 234. The user can then rotate the seat assembly 104 substantially 90 degrees and then slidably insert the tab members of the seat mounting cap 116 back onto the slots 290A-D, apertures, or through holes, of the seat mounting dock 234. In this configuration, the seat assembly 104 is placed in a side-facing configuration. Two additional 90 degree rotations of the seat assembly 104 with respect to the base assembly 102 may also be achieved to allow a user to face the seat assembly 104 in any of four different directions without having to adjust or move the base assembly 102. This adjustment of the facing direction of the seat assembly 104 can also result in a feeling of different rocking motions provided by the four motion modes described below.

In one example, at least one of the seat mounting cap 116 and the seat mounting dock 234 include coupling devices (e.g., screws, bolts, spring-loaded pins and corresponding apertures, etc.) for coupling the seat mounting cap 116 to the seat mounting dock 234. For example, the seat assembly 104 can include a seat latching assembly. The seat latching assembly can include a seat assembly release lever 171 operably coupled to a seat mounting cap latch 172. In one example, a tether, wire, or the like can couple the seat assembly release lever 171 to the seat mounting cap latch 172. Movement of the seat assembly release lever 171 can cause a corresponding movement in the seat mounting cap latch 172. The seat assembly release lever 171 can be positioned along the seat frame 112 adjacent to the seat pan 103, in one example embodiment. Alternatively, the seat assembly release lever 171 can be positioned anywhere else on the seat assembly 104. The seat mounting cap latch 172 can be rotatably coupled to the seat mounting cap 116. In one example, the seat mounting cap latch 172 can be rotatable from a first position to a second position and can be spring-biased in the first position via a spring or other biasing device. The seat mounting cap latch 172 can hold the seat mounting cap 116 to the seat mounting dock 234 in the first position and can allow the seat mounting cap 116 to be decoupled from the seat mounting dock 234 in the second position. In another example embodiment, the tab members of the seat mounting cap 116 are press-fitted into the slots 290A-D, apertures, or through holes of the seat mounting dock 234 to couple the two together.

Figure 2E:
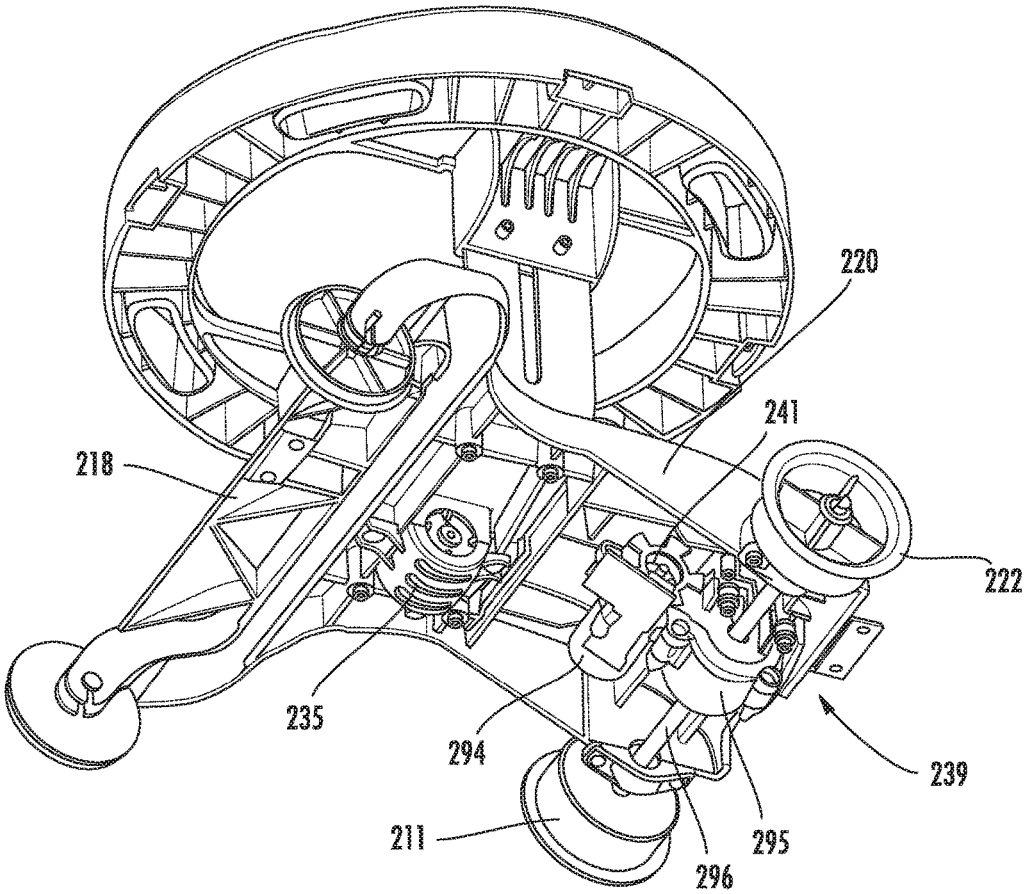
FIG. 2E is a perspective view of the trolley assembly for the adjustable automated child swing/rocker of FIGS. 1A-2D, in accordance with one example embodiment of the disclosure.

FIGS. 2A-D are various views of the internal components of the base assembly 102 for the adjustable automated child swing/rocker 100 of FIGS. 1A-C, in accordance with one example embodiment of the disclosure. FIG. 2E is a perspective view of the trolley assembly 218 for the adjustable automated child swing/rocker 100 of FIG. 1A-2D, in accordance with one example embodiment of the disclosure. Now referring to FIGS. 1A-2E, the base assembly 102 can include a first stationary track 202 coupled to or integrally formed with the base bottom 122 and a second stationary track 204 coupled to or integrally formed with the base bottom 122. The first stationary track 202 can have a first longitudinal axis and the second stationary track 204 can have a second longitudinal axis that is parallel or substantially parallel with the first longitudinal axis and the longitudinal axis A of the base bottom 122. The tracks 202 and 204 are described as stationary because they are not considered to be movable or adjustable with respect to the base bottom 122.

The first stationary track 202 can include a track surface and/or slot 208. In one example, the track surface and/or slot 208 can be positioned along a top edge of the first stationary track 202. For example, the first stationary track 202 can include a flat track surface for a wheel to ride on, a wall extending vertically up from the track surface or adjacent the track surface, and an elongated slot positioned through the wall along one side of the track surface. Each of the flat track surface and slot 208 can extend substantially from the first end to the opposing second end of the first stationary track 202 along the first longitudinal axis. The slot 208 can help to guide the wheel 226 along the track surfaces of the first stationary track 202. For example, an axle can be coupled to the wheel 226 and a portion of the axle can be positioned through the slot 208 to help maintain the wheel 226 along and in contact with the track surface. The track surface and slot 208 can have a pair of track peaks (or high points of the track surface or slot 208) disposed at opposing ends of the first stationary track 202 and a track trough (or low point of the track surface or slot 208). In one example, the track trough can be positioned at substantially the midpoint of the first longitudinal axis for the first stationary track 202. In certain example embodiments, the track surface and/or slot 208 can have a first curved path. The first curved path can have a constant or variable radius. In an alternative embodiment, only one of the track surface and slot 208 are provided to guide the trolley assembly.

The second stationary track 204 can include a track surface and/or slot 210. In one example, the track surface and/or slot 210 can be positioned along a top edge of the second stationary track 204. For example, the second stationary track 204 can include a flat track surface for a wheel to ride on, a wall extending vertically up from the track surface or adjacent the track surface and an elongated slot 210 positioned through the wall along one side of the flat track surface. Each of the flat track surface and the slot 210 can extend substantially from the first end to the opposing second end of the second stationary track 204 along the second longitudinal axis. The slot 210 can help to guide the wheel 230 along the track surface of the second stationary track 204. In an alternative embodiment, only one of the track surface and slot 210 are provided to guide the trolley assembly. In addition, while the example embodiment of FIGS. 2A-D shows one wheel and one flat track surface on each stationary track, this is for example purposes only, as the system can alternatively include two or more wheels and two tracks on each opposing side of the slot, similar to that described with reference to FIGS. 2A-C.

In one example, an axle can be coupled to the wheel 230 and a portion of the axle can be positioned through the slot 210 to help maintain the wheel 230 along and in contact with the track surface. The track surface and slot 210 can have a pair of track peaks (or high points of the track surface or slot 210) disposed at opposing ends of the second stationary track 204 and a track trough (or low point of the track surface or slot 210). In one example, the track trough can be positioned at substantially the midpoint of the second longitudinal axis for the second stationary track 204. In certain example embodiments, the track surface and/or slot 210 can have a first curved path. The first curved path can have a constant or variable radius and can be the same or substantially the same as the curved path for the track surface and/or slot 208.

The base housing can also include an adjustable track platform 207 configured to move along the base bottom 122. In one example, the base bottom 122 can include one or more adjustable track guide slots (214A, 214B collectively referenced as 214) and/or one or more guide railings 215A, 215B, collectively referenced as 215) positioned along the top surface of the base bottom 122. Each of the adjustable track guide slots 214A, 214B can include a pair of spaced-apart vertically extending walls that define a slot therebetween and along which the adjustable track platform 207 can move or translate in opposing directions along the longitudinal axis A. For example, the adjustable track platform 207 can include one or more wheels 261A that are positioned adjacent one side of the platform 207, extend along a bottom side of the platform 207, and run within track guide slot 214A. The adjustable track platform 207 can also include one or more additional wheels 261B that are positioned adjacent an opposing lateral side of the platform 207, extend along the bottom side of the platform 207, and run within track guide slot 214B. In addition, the platform 207 can include one cavity along the bottom side of the platform 207 and extending along the longitudinal axis A that is configured to receive at least a portion of the guide railing 215A and another cavity along the bottom side of the platform 207 and extending along the longitudinal axis A that is configured to receive at least a portion of the second guide railing 215B. The longitudinal axis A can be parallel or substantially parallel with the first longitudinal axis and the second longitudinal axis. In certain example embodiments, at least a portion of the adjustable track platform 207 can be positioned between first stationary track 202 and second stationary track 204.

The adjustable track 206 can include a gear rack 259 extending along the longitudinal axis A of the base bottom 122. In one example, the gear rack 259 can be coupled to and extend out from a lateral side of one of the first guide railing 215A, second guide railing 215B, first track guide slot 214A, or second track guide slot 214B. Alternatively, the gear rack 259 can extend up from the top surface of the base bottom 122. The gear rack 259 can be configured to be operable with an adjustable track drive 216 that can move the adjustable track platform 207 and the first adjustable track 206 and/or the second adjustable track 209 in either direction along the longitudinal axis A.

The adjustable track platform 207 can also include a first adjustable track 206 and a second adjustable track 209. In one example, each of the first adjustable track 206 and the second adjustable track 209 are positioned along a top side of the adjustable track platform 207. The first adjustable track 206 can be coupled to or integrally formed with the adjustable track platform 207 and the second adjustable track 209 can be coupled to or integrally formed with the adjustable track platform 207. The first adjustable track 206 can have a third longitudinal axis and the second adjustable track 209 can have a fourth longitudinal axis that is parallel or substantially parallel with the first longitudinal axis the second longitudinal axis, the third longitudinal axis and the longitudinal axis A of the base bottom 122. The adjustable tracks 206 and 209 are described as adjustable because they are movable or adjustable with respect to the base bottom 122. While the example embodiment of FIGS. 2A-E presents two adjustable tracks 206, 209, in other example embodiments, greater or fewer adjustable tracks may be provided.

The first adjustable track 206 can include a track surface and/or slot. In one example, the track surface and/or slot can be positioned along a top edge of the first adjustable track 206. For example, the first adjustable track 206 can include a flat track surface for a first drive wheel 222 to ride on, a wall extending vertically up from the track surface or adjacent the track surface, and an elongated slot positioned through the wall along one side of the track surface. Each of the flat track surface and slot can extend substantially from the first end to the opposing second end of the first adjustable track 206 along the third longitudinal axis. The slot can help to guide the first drive wheel 222 along the track surface of the first adjustable track 206. For example, a drive axle 296 can be coupled to the first drive wheel 222 and a portion of the drive axle 296 can be positioned through the slot to help maintain the first drive wheel 222 along and in contact with the track surface. The track surface and slot can have a pair of track peaks (or high points of the track surface or slot) disposed at opposing ends of the first adjustable track 206 and a track trough (or low point of the track surface or slot). In one example, the track trough can be positioned at substantially the midpoint of the third longitudinal axis for the first adjustable track 206. In certain example embodiments, the track surface and/or slot can have a third curved path. The third curved path can have a constant or variable radius and can be the same or different from the first curved path and the second curved path for the first stationary track 202 and second stationary track 204 respectively. In an alternative embodiment, only one of the track surface and slot are provided to guide the trolley assembly.

The second adjustable track 209 can include a track surface and/or slot. In one example, the track surface and/or slot can be positioned along a top edge of the second adjustable track 209. For example, the second adjustable track 209 can include a flat track surface for a second drive wheel 211 to ride on, a wall extending vertically up from the track surface or adjacent the track surface, and an elongated slot positioned through the wall along one side of the flat track surface. Each of the flat track surface and slot can extend substantially from the first end to the opposing second end of the second adjustable track 209 along the fourth longitudinal axis. The slot can help to guide the second drive wheel 211 along the track surface of the second adjustable track 209. While the example embodiment of FIGS. 2A-D show one wheel and one flat track surface on each adjustable track, this is for example purposes only as the system can alternatively include two or more wheels and two tracks on each opposing side of the slot.

In one example, the drive axle 296 can be coupled to the second drive wheel 211 and a portion of the drive axle 296 can be positioned through the slot of the second adjustable track 209 to help maintain the second drive wheel 211 along and in contact with the track surface. The track surface and slot of the second adjustable track 209 can have a pair of track peaks (or high points of the track surface or slot) disposed at opposing ends of the second adjustable track 209 and a track trough (or low point of the track surface or slot). In one example, the track trough is positioned at substantially the midpoint of the fourth longitudinal axis for the second adjustable track 209. In certain example embodiments, the track surface and/or slot can have a fourth curved path. The fourth curved path can have a constant or variable radius and can be the same or substantially the same as the third curved path for the first adjustable track 206. In an alternative embodiment, only one of the track surface and slot are provided to guide the trolley assembly.

In one example, the length, height, and curvature of each of the first stationary track 202, second stationary track 204, first adjustable track 206, and second adjustable track 209 is the same or substantially equal. While the example embodiment shows the base housing having two stationary tracks 202, 204 and two adjustable tracks 206, 209, in other example embodiments one or more stationary tracks may be provided and/or one or more adjustable tracks may be provided and are considered within the scope of the present disclosure.

The base housing can also include an adjustable track drive 216 coupled to the adjustable track platform 207 and operably coupled to the transmission rack gear 259. For example, the adjustable track drive 216 can be positioned along a top side of the adjustable track platform 207 and can include a drive mechanism that interacts with the transmission rack gear 259 to move or adjust the adjustable track platform 207 in either opposing direction along the longitudinal axis A.

The movement of the adjustable track platform 207 with respect to the first stationary track 202 and the second stationary track 204 changes the distance between the stationary track troughs of the first and second stationary tracks 202, 204 and the adjustable track troughs of the first and second adjustable tracks 206, 209 along a longitudinal axis parallel with the longitudinal axis A. The distance between the stationary track troughs and the adjustable track troughs is shown in one example in FIG. 5 with reference to the stationary tracks 202, 204, the adjustable tracks 206, 209 and the distance X between the troughs of the stationary tracks 202, 204 and the adjustable tracks 206, 209. The positioning, and thereby the movement, of the adjustable tracks 206, 211 with respect to the first stationary track 202 and second stationary track 204, also changes the type of motion that is created on the seat assembly 104 as the trolley assembly 218 moves along the tracks 202, 204, 206, and 209. In one example, by modifying the position of the adjustable tracks 206, 211 with respect to the first stationary track 202 and second stationary track 204 (and thereby changing the distance X), the child rocker 100 can achieve four different motion types: rock, glide, swing, and cradle. Graphical representations of each of these four motion types are provided in FIGS. 4A-4D respectively and can be equally implemented on the child rocker 100 of FIGS. 1A-3.

Figures 4A, 4B, 4C, 4D:
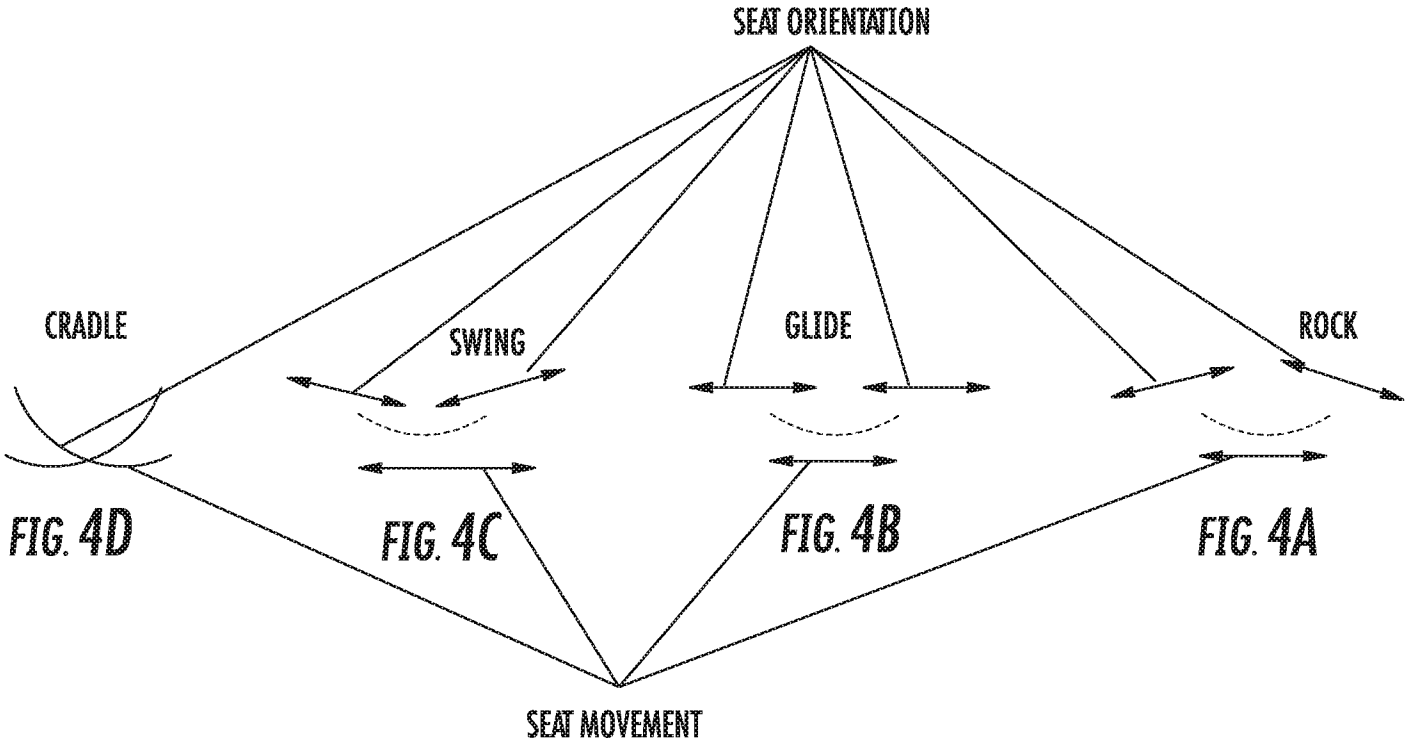
FIGS. 4A-D are representations of four different motions of the seat assembly for the automated child swing/rocker of FIGS. 1A-3, in accordance with one example embodiment of the disclosure.

For example, the rock motion, as shown in FIG. 4A, can be described as a front to back motion with the seat pan 103 and seat (created by the soft goods) of the seat assembly 104 tilting to the outside in each direction. The glide motion, as shown in FIG. 4B, can be described as a front to back motion with the seat pan 103 and seat (created by the soft goods) of the seat assembly 104 staying level with the ground or surface upon which the base assembly 102 rests. The swing motion, as shown in FIG. 4C, can be described as just the opposite of the rock motion, where the seat pan 103 and seat (created by the soft goods) of the seat assembly 104 tilts inward as it moves front to back. The cradle motion, as shown in FIG. 4D, can be described as being similar to the swing motion, where the seat pan 103 and seat (created by the soft goods) of the seat assembly 104 tilts inward, but the front to back motion is little to none. The cradle motion could even be described as pivoting.

Figure 5:
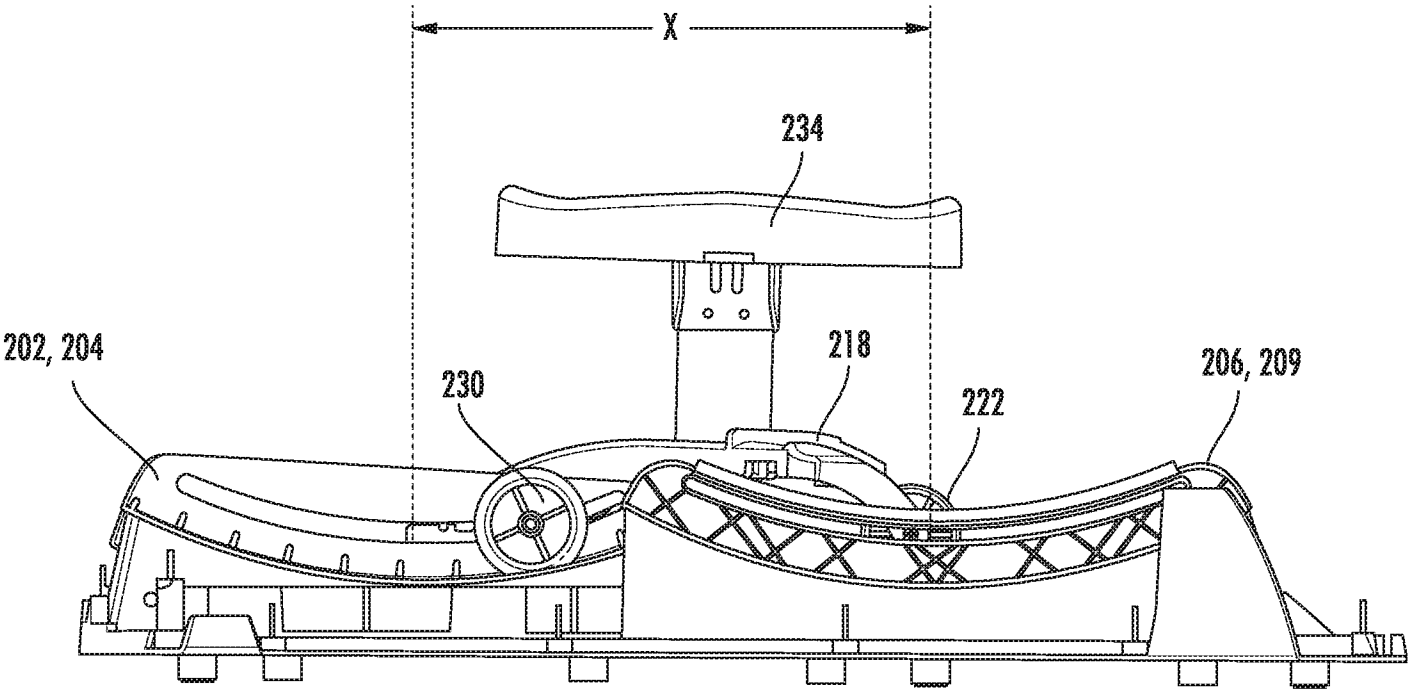
FIG. 5 is a side elevation view of the internal components of the base assembly and trolley assembly of FIGS. 1A-3, in accordance with one example embodiment of the disclosure.

As best shown in FIG. 5, the determination of which motion type occurs can be based on the distance X between the stationary track troughs 291 and the adjustable track trough 292 along a longitudinal axis parallel with the longitudinal axis A. Referring to FIGS. 1A-5, for example, a parent or guardian can select the desired motion type at the user interface control panel 107. If the first and second adjustable tracks 206, 209 are not already in the position for the selected motion type, the processor can instruct the adjustable track drive 216 to move the adjustable track platform 207 along the adjustable track guide slots 214*a*, 214B, and adjustable track guide railings 215A, 215B until the preset distance X between the stationary track troughs 291 and the adjustable track troughs 292 along a longitudinal axis parallel with the longitudinal axis A is reached. In one example, the base bottom 122 can include one or more encoders 253 (three shown in FIGS. 2C-2D), communicably coupled to the processor or other control system and each configured to sense one of the one or more position identifying ribs 251A, 251B, 251C corresponding to the position the first and second adjustable tracks 206, 209 need to be with respect to the first and second stationary tracks 202, 204 to have the proper distance X between troughs 291, 292 for a desired motion type. As the adjustable track platform 207 moves, one or more of the position identifying ribs 251A-C can pass next to one of the encoders 253 and communicate to the processor or other control system that it is in a particular position for one of the motions types. If this is the selected motion type, then the processor will signal to the adjustable track drive 216 to stop moving the adjustable track platform 207. Otherwise, the adjustable track platform and the first and second adjustable tracks 206, 209 therewith will continue to be moved by the adjustable track drive 216.

In one example embodiment, the distance X for the cradle motion is less than the distance X for the swing motion, which is less than the distance X for the glide motion, which is less than the distance X for the rock motion. In one example, the distance X for the cradle motion is between substantially 20 millimeters (mm) and substantially 100 mm and preferably between substantially 65 mm and substantially 85 mm, and more preferably substantially 77.5 mm. In one example, the distance X for the swing motion is between substantially 100 mm and substantially 180 mm and preferably between substantially 120 mm and substantially 150 mm, and more preferably substantially 130 mm. In one example, the distance X for the glide motion is between substantially 170 mm and substantially 220 mm and preferably between substantially 190 mm and substantially 210 mm, and more preferably substantially 203.5 mm. In one example, the distance X for the glide motion is equal or substantially equal to the distance between the wheel 226 and the wheel 230 (i.e., the wheelbase width). In one example, the distance X for the rock motion is between substantially 230 mm and substantially 300 mm and preferably between substantially 260 mm and substantially 285 mm, and more preferably substantially 275 mm.

The base housing can also include the trolley assembly 218. The trolley assembly 218 can be configured to be removably coupled to the seat assembly 104 and to move along the first stationary track 202, second stationary track 204, first adjustable track 206, and second adjustable track 209 to cause a corresponding movement in the seat assembly 104 removably coupled thereto. The trolley assembly 218 can include a front mounting panel 220, a first track arm 224, and a second track arm 228. Each of the first mounting panel 220, first track arm 224, and second track arm 228 have a first end coupled to or integrally formed with a central hub of the trolley assembly 218 and a second distal end. The first drive wheel 222 and second drive wheel 211 are operably coupled to the first mounting panel 220. The first guide wheel 226 and second guide wheel 230 are operably coupled to the distal second ends of the corresponding first track arm 224 and second track arm 228.

The first guide wheel 226 can be coupled to the first track arm 224 by an axle such that the first guide wheel 226 rotates about the axle. The axle can have a length such that it can extend through the first guide wheel 226 and have an additional portion that extends through and moves along the slot 208 in the first stationary track 202 to help maintain the outer circumference of the first guide wheel 226 on the track surfaces of the first stationary track 202.

The second guide wheel 230 can be coupled to the second track arm 228 by an axle such that the second guide wheel 230 rotates about the axle. The axle can have a length such that it can extend through the second guide wheel 230 and have an additional portion that extends through and moves along the slot 210 in the second stationary track 204 to help maintain the outer circumference of the second guide wheel 230 on the track surface of the second stationary track 204.

While the example embodiment shows the trolley assembly 218 having two arms and four wheels, in other example embodiments, more than two arms and/or two or more wheels may be used and are considered within the scope of the present disclosure. Further, in other example embodiments, the positioning of the tracks 202, 204, 206, and 209 and the wheels 211, 222, 226, and 230 can be inverted such that the trolley assembly 218 can include the four tracks positioned along each of the first mounting panel 220, first track arm 224, and second track arm 228 and the base bottom 122 can include the four wheels (e.g., wheels 211, 222, 226, and 230) to run on the corresponding four tracks.

In certain example embodiments, the first mounting panel 220 can also include a direct seat drive system 239 coupled to a bottom side of the mounting panel 220. The direct seat drive system 239 can be configured to generate movement of the trolley assembly 218 along the stationary and adjustable tracks 202, 204, 206, and 209 to cause a corresponding movement (e.g., cradle, glide, rocking or swinging) of the seat assembly 104. In one example, the direct seat drive system 239 can be coupled to the drive axle 296 that is coupled to the first drive wheel 222 and second drive wheel 211 that run on the first adjustable track 206 and second adjustable track 209 respectively. However, this is for example purposes only as the direct seat drive system 239 can alternatively be used to drive any of the wheels of the trolley assembly 218.

The direct seat drive system 239 can include a motor 294. The motor 294 can be communicably coupled to the processor (not shown) or other control system and electrically coupled to a battery or other power source (not shown). The motor 294 can include an output shaft that is coupled to a transmission 295. The transmission 295 can be coupled at an input drive end to the motor 294 and at an output drive end to the drive shaft 296, which then drives the first drive wheel 222 and second drive wheel 211. In one example, each of the first drive wheel 222 and second drive wheel 211 can be a friction wheel having a friction increasing surface along the outer circumference of the wheel.

The direct seat drive system 239 can also include an encoder 241. In one example, the direct seat drive system 239 can be operably coupled to the first drive wheel 222 and the second drive wheel 211 to generate motion in the trolley assembly 218. The encoder 241 can be operably coupled to the processor (not shown) or other control system and can provide feedback data to the processor or other control system regarding the position of the first drive wheel 222 and the second drive wheel 211 along the first adjustable track 206 and the second adjustable track 209 respectively and/or the amount of movement that has been accomplished by the first drive wheel 222 and second drive wheel 211 along the first adjustable track 206 and the second adjustable track 209 respectively. The feedback data from the encoder 241 can be used by the processor or other control system to determine the actual position of the first drive wheel 222 and the second drive wheel 211 along the first adjustable track 206 and the second adjustable track 209 respectively, and correspondingly the position of the seat assembly 104 in the desired motion mode. This data can then be used by the processor or other control system to determine when to change the direction of the direct seat drive system 239 to move the first drive wheel 222 and second drive wheel 211 in the opposite direction along the first adjustable track 206 and second adjustable track 209 respectively to provide the desired/selected motion for the child rocker 100. The encoder 241 can be an encoder wheel that monitors the revolutions per minute of the motor 294 of the direct seat drive system 239. In an alternate embodiment, rather than the direct seat drive system 239, the child rocker 100 can include an indirect seat drive system.

The trolley assembly 218 can also include a mounting bracket 232. In one example embodiment, the mounting bracket 232 is a U-shaped bracket 232 having a first end coupled to the hub of the trolley assembly 218 and two opposing, spatially-separated arm members 237A, 237B coupled to different points on the seat mounting dock 234. In an alternate embodiment, the mounting bracket 232 can be an elongated member having a circular or other geometric cross-section along the longitudinal axis of the mounting bracket 232 and can have a first end coupled to the hub of the trolley assembly 218 and an opposing second end coupled to the seat mounting dock 234. In one example, the mounting bracket 232 includes one or more portions (e.g., the arm members 237A and 237B) that extend vertically or substantially vertically down or up (depending on which element the first end of the mounting bracket 232 is attached to) from the mounting bracket 232.

In certain example embodiments, the trolley assembly 218 can also include a vibration motor 235 for generating a vibration in the seat assembly 104. In one example, the vibration motor 235 can be positioned along the hub or another portion of the trolley assembly 218 (e.g., along a bottom surface of the hub and/or the mounting panel 220 for generating a vibration along the trolley assembly 218 and the seat assembly 104 attached to the seat mounting dock 234. The trolley assembly 218 can also include the seat mounting dock 234. The seat mounting dock 234 can be configured to be removably coupled to the seat mounting cap 116 of the seat assembly 104 as discussed above with reference to FIG. 1B.

Figure 3:
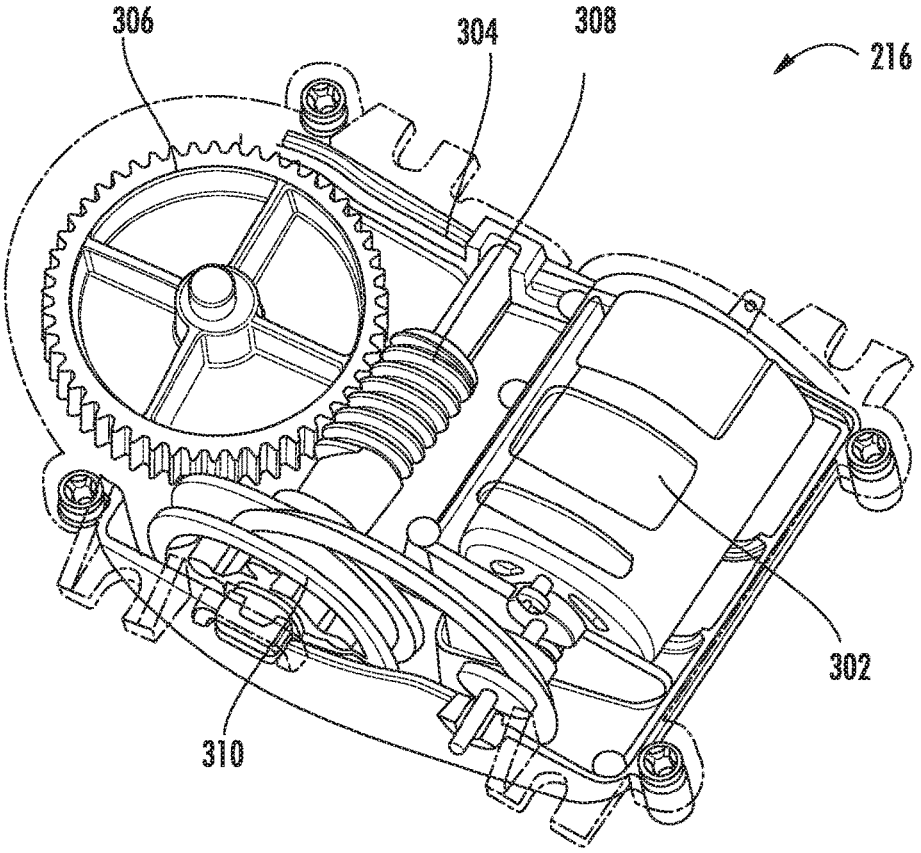
FIG. 3 is a perspective view of the adjustable track drive for the automated child swing/rocker of FIG. 1A-2E, in accordance with one example embodiment of the disclosure.

FIG. 3 is a perspective view of the adjustable track drive 216 for the automated child swing/rocker 100 of FIG. 1A-2E, in accordance with one example embodiment of the disclosure. Referring now to FIGS. 1A-3, the adjustable track drive 216 can be coupled to the adjustable track platform 207 and within the base cavity of the base assembly 102. In one example, the adjustable track drive 216 can be coupled to a top surface of the adjustable track platform 207. Alternatively, the drive 216 can be coupled to the bottom surface or a side surface of the adjustable track platform 207. The adjustable track drive 216 can be configured to move the adjustable track platform 207 along the longitudinal axis A in either one of two opposing directions. The adjustable track drive 216 can include a motor 302 that is communicably coupled to the processor (not shown) or other control system and electrically coupled to a battery or other power source. The adjustable track drive 216 can also include a transmission 304 operably coupled to the drive shaft of the motor 302. In one example, the transmission 304 is operably coupled to the motor 302 via two or more pulleys 310 and a belt drive system. Alternatively, the transmission 304 is directly coupled to the drive shaft of the motor 302.

In one example, the transmission 304 can include small and large pulleys and a worm gear 308. The worm gear 308 is configured to interact with and drive a pinion gear 306 that is operably coupled to the output side of the transmission 304. For example, rotation of the worm gear 308 about a first axis drives the pinion gear 306 to rotate about a second axis that is orthogonal or substantially orthogonal to the first axis. The teeth of the pinion gear 306 are configured to interact with the teeth of the rack gear 259 to move the adjustable track platform 207 with respect to the base bottom 122 along the longitudinal axis A. In other example embodiments other types of gears and other configurations of the gears may be used as known by those of ordinary skill in the art to provide the same or similar output from the transmission.

While the above description contains many specifics, these specifics should not be construed as limitations on the scope of the disclosure, but merely as exemplifications of the disclosed embodiments. Those skilled in the art will envision many other possible variations that are within the scope of the disclosure.

Additionally, although example embodiments have been described in language specific to structural features and/or methodological acts, it is to be understood that the disclosure is not necessarily limited to the specific features or acts described. Rather, the specific features and acts are disclosed as illustrative forms of implementing the example embodiments. Conditional language, such as, among others, "can," "could," "might," or "may," unless specifically stated otherwise, or otherwise understood within the context as used, is generally intended to convey that certain example embodiments could include, while other example embodiments do not include, certain features, elements, and/or steps. Thus, such conditional language is not generally intended to imply that features, elements, and/or steps are in any way required for one or more embodiments.

What is claimed is:

1. An adjustable child rocker comprising:

a seat assembly comprising a seat configured to receive a child;

a trolley assembly operably coupled to the seat assembly and comprising a plurality of wheels;

at least one stationary track;

a first adjustable track; and a second adjustable track, wherein the first adjustable track is adjustable from at least a first position to a second position and the second adjustable track is adjustable from at least a third position to at least a fourth position;

wherein a first wheel of the plurality of wheels moves along the at least one stationary track, a second wheel of the plurality of wheels moves along the first adjustable track, and a third wheel of the plurality of wheels moves along the second adjustable track.

2. The adjustable child rocker of claim 1, wherein each of the at least one stationary track, the first adjustable track and the second adjustable track comprises an arcuate track and wherein the first wheel engages a first arcuate track on the at least one stationary track, the second wheel engages a second arcuate track on the first adjustable track, and the third wheel engages a third arcuate track on the second adjustable track.

3. The adjustable child rocker of claim 1, further comprising:

a housing comprising a base bottom and a housing cover, wherein the base bottom and housing cover define a housing cavity; and an adjustable track platform disposed within the housing cavity and adjustable with respect to the base bottom, wherein the first adjustable track and the second adjustable track are disposed on the adjustable track platform.

4. The adjustable child rocker of claim 3, further comprising an adjustable track drive disposed on the adjustable track platform.

5. The adjustable child rocker of claim 4, further comprising a gear disposed adjacent the base bottom and having a first longitudinal axis substantially parallel to a longitudinal axis of the base bottom;

wherein the adjustable track drive engages the gear to adjust the first adjustable track from at least the first position to the second position and adjust the second adjustable track from at least the third position to the fourth position.

6. The adjustable child rocker of claim 4, wherein the adjustable track drive comprises:

a motor; and a transmission operably coupled to the motor.

7. The adjustable child rocker of claim 1, wherein the trolley assembly comprises:

a central hub;

a first mounting panel extending from the central hub and comprising the first wheel and a fourth wheel of the plurality of wheels;

a first track arm comprising a first end coupled to the central hub and a distal second end coupled to the second wheel of the plurality of wheels;

a second track arm comprising a first end coupled to the central hub and a distal second end coupled to the third wheel of the plurality of wheels; and a seat mounting dock configured to be removably coupled to the seat assembly.

8. The adjustable child rocker of claim 7, wherein the first wheel and the fourth wheel are drive wheels coupled to a seat drive system.

9. The adjustable child rocker of claim 8, wherein the seat drive system is coupled to the trolley assembly.

10. The adjustable child rocker of claim 8, wherein the seat drive system comprises:

a motor;

a transmission operably coupled to the motor; and a drive shaft operably coupled to the transmission;

wherein the first wheel and the fourth wheel are coupled to the drive shaft.

11. The adjustable child rocker of claim 7, wherein the seat mounting dock comprises:

an annular ring body; and a plurality of slots disposed in the annular ring body.

12. The adjustable child rocker of claim 11, wherein the plurality of slots comprises four slots and wherein each of the fours slots is disposed through the annular ring body at 90 degree intervals about the annular ring body.

13. The adjustable child rocker of claim 1, wherein the at least one stationary track comprises a first stationary track and a second stationary track and wherein at least a portion of the first adjustable track and the second adjustable track is disposed between the first stationary track and the second stationary track.

14. The adjustable child rocker of claim 13, wherein the first stationary track comprises a first longitudinal axis, the second stationary track comprises a second longitudinal axis, the first adjustable track comprises a third longitudinal axis, and the second adjustable track comprises a fourth longitudinal axis and wherein the first longitudinal axis, the second longitudinal axis, the third longitudinal axis, and the fourth longitudinal axis are substantially parallel.

15. The adjustable child rocker of claim 1, further comprising:

a processor;

a control panel communicably coupled to the processor;

an adjustable track drive communicably coupled to the processor and operably coupled to the first adjustable track and the second adjustable track to move the first adjustable track from the first position to the second position and the second adjustable track from the third position to the fourth position; and a seat drive communicable coupled to the processor and operably coupled to the trolley assembly.

16. The adjustable child rocker of claim 15, wherein the adjustable track drive is further configured to move the first adjustable track from the second position to a fifth position and from the fifth position to a sixth position and configured to move the second adjustable track from the fourth position to a seventh position and from the seventh position to an eighth position, wherein when the first adjustable track is in the first position and the second adjustable track is in the third position, the trolley assembly generates a rocking motion at the seat assembly, wherein when the first adjustable track is in the second position and the second adjustable track is in the fourth position, the trolley assembly generates a glide motion at the seat assembly, wherein when the first adjustable track is in the fifth position and the second adjustable track is in the seventh position, the trolley assembly generates a swing motion at the seat assembly, and wherein when the first adjustable track is in the sixth position and the second adjustable track is in the eighth position, the trolley assembly generates a cradle motion at the seat assembly.

17. The adjustable child rocker of claim 1, wherein each of the at least one stationary track, first adjustable track, and second adjustable track comprises:

a substantially flat track surface;

a wall extending up from the substantially flat track surface; and an elongated slot disposed through the wall.

18. A method of changing a swing mode for an adjustable child rocker from a first swing mode to a second swing mode, comprising:

providing the child rocker comprising:

a seat assembly comprising a seat configured to receive a child;

a trolley assembly operably coupled to the seat assembly and comprising a first guide wheel, a second guide wheel, a first drive wheel, and a second drive wheel;

a first stationary track, wherein the first guide wheel abuts the first stationary track;

a second stationary track, wherein the second guide wheel abuts the second stationary track;

a first adjustable track, wherein the first drive wheel abuts the first adjustable track; and a second adjustable track, wherein the second drive wheel abuts the second adjustable track and wherein the first adjustable track is adjustable from at least a first position to a second position and the second adjustable track is at least adjustable from a third position to a fourth position;

a processor;

a control panel communicably coupled to the processor;

an adjustable track drive operably coupled to the first adjustable track and the second adjustable track and communicably coupled to the processor; and a seat drive coupled to the trolley assembly for driving the first drive wheel and the second drive wheel and communicably coupled to the processor;

receiving, at the control panel, an indication to change the swing mode from the first mode to the second mode;

transmitting, by the processor, a first signal to the adjustable track drive to move the first adjustable track from the first position to the second position and the second adjustable track from the third position to the fourth position;

moving, by the adjustable track drive, the first adjustable track from the first position to the second position and the second adjustable track from the third position to the fourth position;

transmitting, by the processor, a second signal to the seat drive to drive the first drive wheel and the second drive wheel on the trolley assembly; and generating, by the seat drive, a movement in the trolley assembly wherein the movement in the trolley assembly causes a corresponding movement in the seat assembly in the second mode.

19. The method of claim 18, wherein the first mode is one of a rock motion, a glide motion, a swing motion, and a cradle motion and wherein the second mode is a different one of the rock motion, the glide motion, the swing motion, and the cradle motion.

20. An adjustable child rocker comprising:

a seat assembly comprising a seat;

a trolley assembly operably coupled to the seat assembly and comprising: a first wheel, a second wheel, a third wheel, and a fourth wheel;

a first stationary arcuate track;

a second stationary arcuate track;

a first linearly adjustable arcuate track operable to move in a first linear direction with respect to the first stationary track and the second stationary track;

a second linearly adjustable arcuate track operable to move in a second linear direction with respect to the first stationary track and the second stationary track, wherein the first adjustable track is adjustable from at least a first position to a second position and the second adjustable track is adjustable from at least a third position to at least a fourth position; and an adjustable track drive operably coupled to the first linearly adjustable arcuate track and the second linearly adjustable arcuate track and configured to move the first linearly adjustable arcuate track in the first linear direction and the second linearly adjustable arcuate track in the second linear direction, wherein the first wheel moves along the first stationary track, the second wheel moves along the second stationary track, the third wheel moves along the first adjustable track, and the fourth wheel moves along the second adjustable track.

* * * * *